US008297864B2

(12) United States Patent
Tsugaru et al.

(10) Patent No.: US 8,297,864 B2
(45) Date of Patent: Oct. 30, 2012

(54) PRINTER

(75) Inventors: Hiroyuki Tsugaru, Saitama (JP); Tetsuya Yamamoto, Tokyo (JP); Katsutoshi Mukaijima, Tokyo (JP); Gen Matsushima, Tokyo (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 316 days.

(21) Appl. No.: 12/722,885

(22) Filed: Mar. 12, 2010

(65) Prior Publication Data

US 2010/0247221 A1 Sep. 30, 2010

(30) Foreign Application Priority Data

Mar. 30, 2009 (JP) ..... 2009-082830

(51) Int. Cl.
*B41J 11/00* (2006.01)

(52) U.S. Cl. ..... 400/621; 400/593

(58) Field of Classification Search ..... 400/621
See application file for complete search history.

(56) References Cited

U.S. PATENT DOCUMENTS

| | | | | |
|---|---|---|---|---|
| 6,118,469 | A * | 9/2000 | Hosomi | 347/222 |
| 6,508,600 | B1 | 1/2003 | Nonaka | |
| 6,988,843 | B2 * | 1/2006 | Song | 400/621 |
| 7,097,373 | B2 * | 8/2006 | Mochizuki et al. | 400/621 |
| 7,404,683 | B2 * | 7/2008 | Mochizuki et al. | 400/613.1 |
| 7,547,153 | B2 | 6/2009 | Yoshioka | |
| 7,731,437 | B2 * | 6/2010 | Shirotori et al. | 400/621 |
| 7,988,374 | B2 * | 8/2011 | Kohira | 400/621 |
| 2002/0060260 | A1 * | 5/2002 | Imai et al. | 242/348.4 |
| 2007/0104527 | A1 * | 5/2007 | Watanabe et al. | 400/621 |

FOREIGN PATENT DOCUMENTS

| | | |
|---|---|---|
| JP | HEI7-121514 | 12/1995 |
| JP | 2004-314302 | 11/2004 |
| JP | 3800891 | 5/2006 |
| JP | 2006-289574 | 10/2006 |
| JP | 2007-062159 | 3/2007 |
| JP | 4174489 | 8/2008 |

OTHER PUBLICATIONS

Japanese Patent Office "Notice of Rejection" issued for corresponding Japanese Patent Application No. 2009-082830, mailed May 24, 2011. Partial English translation attached.

Japanese Patent Office "Office Action" issued for corresponding Japanese Patent Application No. 2009-082830, dated Feb. 3, 2011. Partial English translation attached.

* cited by examiner

*Primary Examiner* — Anthony Nguyen
(74) *Attorney, Agent, or Firm* — Myers Wolin, LLC

(57) ABSTRACT

A printer includes a fixed blade attached to a cover unit; a movable blade that faces a fixed blade, freely reciprocates relative to the fixed blade when the cover unit is closed and cuts the recording medium together with the fixed blade by overlapping the fixed blade during reciprocation; a movable blade driving motor that causes the movable blade to reciprocate; and a movable blade unit that includes the movable blade, the movable blade driving motor, and an accommodating unit accommodating the movable blade and provided at a printer main body. The printer further includes a mechanism that, when the movable blade protrudes from the accommodating unit and is stopped, widens a space over which the fixed blade and the protruding movable blade face each other before the movable blade driving motor accommodates the protruding movable blade in the accommodating unit, as initiated by operation of a cover opening lever.

4 Claims, 10 Drawing Sheets

PRINTER

CROSS-REFERENCE TO RELATED APPLICATIONS

This application is based upon and claims the benefit of priority of the prior Japanese Patent Application No. 2009-082830, filed on Mar. 30, 2009, now pending, the entire contents of which are herein wholly incorporated by reference.

BACKGROUND OF THE INVENTION

1. Field of the Invention

The present invention relates to a printer that holds a recording medium wound in a roll and that prints on the recording medium.

2. Description of the Related Art

Among printers that print on a recording medium wound in a roll, are those that include a cutting apparatus, which cuts the recording medium to a proper length after printing. Such a cutting apparatus, for example, includes a fixed blade and a movable blade disposed separable from each other, and cuts a recording medium positioned between the fixed blade and the movable blade by sliding the movable blade relative to the fixing blade.

In the cutting apparatus configured to cut a recording medium by sliding the movable blade relative to the fixing blade, a state may occur where the recording medium becomes caught between the fixed blade and the movable blade, restricting and locking the operation of the movable blade, i.e., so-called cutter jam. Conventionally, when such cutter jam occurs, the movable blade is released by, for example, removing the caught recording medium, by causing the movable blade to return in direction by an operator manually rotating a gear coupled to the movable blade.

Various techniques address measures against cutter jam. More specifically, a conventional automatic cutting apparatus includes a cutter to cut out a paper sheet, a driving mechanism that causes the cutter to reciprocate, a driving motor to power to the driving mechanism, a lock detecting unit that detects a locked state of the cutter by monitoring a cutting action of the cutter with regard to the relation between the cutting action and a predetermined time, and a control unit that controls the driving motor to reverse rotation to release the locked state of the cutter when a locked state of the cutter is detected by the lock detecting unit (see, Patent Document 1).

For example, a conventional cutting apparatus includes an upper frame attached to a base frame being freely opened and closed, a movable blade unit provided at the upper frame, and a driving mechanism to transmit a driving force from a driving source to the movable blade unit, where the movable blade unit is attached to the upper frame being displaceable relative to the upper frame. Further, a cutter locking mechanism is provided at the upper frame and includes an opening and closing lever that allows the upper frame to transition from a closed state to an open state; a cutter locking lever that fixes the position of the movable blade unit and couples the movable blade unit to the driving mechanism or that releases the fixed position of the movable blade unit and releases the coupling of the movable blade unit and the driving mechanism, interlocked with the opening and closing lever; and a latching lever that latches the upper frame in a closed state or releases the closed state interlocked with the opening and closing lever. Further, before the latch of the upper frame by the latching lever is released and the state of the upper frame transitions to an open state by operation of the opening and closing lever, when the upper frame is closed, the fixed position of the movable blade unit by the cutter locking lever is released and the coupling between the movable blade unit and the driving mechanism is released (see Patent Document 2).

For example, a conventional printer includes a printer main body that includes a paper sheet accommodating unit, a paper sheet conveying path, and a printing mechanism printing on a paper sheet conveyed in the paper sheet conveying path; a main body cover attached to the printer main body being freely rotatable to close the paper sheet accommodating unit and being freely detachable from the printer main body; and a paper sheet cutting mechanism that cuts a paper sheet and is on the downstream side of the printing mechanism in the paper sheet conveying path, where the paper sheet cutting mechanism includes a fixed blade provided in the printer main body; a movable blade that is provided in the main body cover, faces the fixed blade sandwiching the paper sheet conveying path therebetween in a state where the main body cover is closed, freely reciprocates relative to the fixed blade and cuts a paper sheet in cooperation with the fixed blade by overlapping the fixed blade on the downstream side of the paper sheet conveying path and on the side of the main body cover that is opened during forward movement of the movable blade; and a driving unit that causes the movable blade to reciprocate (see, e.g., Patent Document 3).

[Patent Document 1] Japanese Patent Application Laid-Open Publication No. H7-121514

[Patent Document 2] Japanese Patent Publication No. 4174489

[Patent Document 3] Japanese Patent Publication No. 3800891

However, according to the above conventional techniques, an operator must manually rotate the gear coupled to the movable blade until the locking of the movable blade is released. Therefore, a problem arises in that considerable time is consumed to resolve cutter jam.

According to the conventional technique described in Patent Document 1 above, when cutter jam occurs, the recording medium is caught between the fixed blade and the movable blade, and the movable blade becomes locked, unable to move forward or backward. Therefore, the movable blade (cutter) does not operate even when the driving motor is rotated reversely. Hence, a problem arises in that cutter jam cannot be resolved.

According to the conventional technique described in Patent Document 2 above, the movable blade is provided on the cover (upper frame) and the driving source that causes the movable blade to operate is provided on the base frame that is a component separate from the upper frame. Therefore, the driving mechanism including a gear train to transmit the driving force of the driving source to the movable blade, etc., becomes complicated and the number of parts tends to increase. Consequently, a problem arises in that the overall size of the apparatus becomes large.

According to the conventional technique described in Patent Document 3 above, the printer has a structure in which the cover opens even when cutter jam occurs and the movable blade remains protruding. Therefore, a problem arises in a risk of the operator touching the movable blade and becoming injured.

To solve the problems associated with the conventional techniques above, an object of the present invention is to provide a printer that ensures the safety of a user of the printer and enables easy resolution of cutter jam.

SUMMARY OF THE INVENTION

To solve the problems above and achieve an object, a printer according to the present invention includes a recording medium accommodating unit; a printer main body that includes a printing unit that prints on a recording medium conveyed from the recording medium accommodating unit; a cover unit that is rotatably attached to the printer main body and covers the recording medium accommodating unit; a fixed blade that is attached to the cover unit downstream from the printing unit in a recording medium conveyance direction; a movable blade that faces the fixed blade, freely reciprocates relative to the fixed blade when the cover unit is closed, and upon reciprocating and in cooperation with the fixed blade, cuts the recording medium inserted between the movable blade and the fixed blade by overlapping a side of the fixed blade downstream in the recording medium conveyance direction; a movable blade driving unit that causes the movable blade to reciprocate; and a movable blade unit that includes the movable blade, the movable blade driving unit, and an accommodating unit accommodating the movable blade, the movable blade unit being provided at the printer main body. The printer further includes a mechanism that, when the movable blade is protruded from the accommodating unit and is stopped, widens a space over which the fixed blade and the protruding movable blade face each other before the movable blade driving unit accommodates the protruding movable blade in the accommodating unit, as initiated by operation of an operating unit.

According to the present invention, when the operating unit is operated in a state where the movable blade is stopped at a position such that the movable blade protrudes from the accommodating unit, an allowance of space enabling the movable blade to operate is secured by widening the space over which the fixed blade and the protruding movable blade face each other, before the movable blade driving unit accommodates the protruding movable blade in the accommodating unit.

Thereby, when the operating unit is operated in a state where the movable blade is stopped at a position such that the movable blade protrudes from the accommodating unit, the covering unit may be opened after the protruding movable blade is securely accommodated in the accommodating unit by the movable blade driving unit after widening the space over which the fixed blade and the protruding movable blade face each other.

Further, the printer of the present invention further includes a biasing member that biases the movable blade unit in a downstream direction with respect to the recording medium conveyance direction; and a movable blade unit locking mechanism that locks the movable blade unit to the printer main body when the movable blade overlaps the fixed blade, where the printer is configured to release the movable blade unit locking mechanism through operation of the operating unit.

According to the present invention, the movable blade unit is biased toward the downstream side in the recording medium conveyance direction and therefore, when locking of the movable blade unit by the movable blade unit locking mechanism is released in conjunction with the operation of the operating unit, accompanying the release, the movable blade unit is moved to a position downstream in the recording medium conveyance direction, and an allowance of space enabling the movable blade to operate is secured.

Thereby, using the existing biasing member of the movable blade unit that is provided to simplify detachment operation for the movable blade unit, an allowance of space enabling the movable blade to operate is secured, and the cover unit may be opened after securely accommodating the protruding movable blade in the accommodating unit by the movable blade driving unit, without any complication of the configuration.

The printer of the present invention further includes a cover unit locking mechanism that is locks with the printer main body when the cover unit is closed, where the printer is configured to release the cover unit locking mechanism by operation of the operating unit.

According to the present invention, the space over which the fixed blade and the protruding movable blade face each other may be widened accompanying the release of the locking by the cover unit locking mechanism in conjunction with operation of the operating unit. Therefore, when the locking by the cover unit locking mechanism is released to open the cover unit, the cover unit is opened in a state where the movable blade is accommodated securely in the accommodating unit.

Thus, simply by the operator of the printer executing an operation to open the cover unit, an allowance of space enabling the movable blade to operate is secured, and the cover unit may be opened after the protruding movable blade is securely accommodated in the accommodating unit by the movable blade driving unit, without causing the operator of the printer to particularly pay attention to the accommodation of the movable blade.

In the printer of the present invention, the movable blade unit is detachable from the printer main body.

According to the present invention, parts such as the movable blade and the driving unit that constitute the movable blade unit and degrade with use, can be replaced as a unit. Therefore, simplification of replacement operation of the movable blade and the movable blade driving unit due to aging is facilitated.

Effect

According to the printer of the present invention, even when cutter jam occurs, the cover unit may be opened after the protruding movable blade is securely accommodated in the accommodating unit by the movable blade driving unit. Therefore, an effect is achieved that the safety of a user of the printer may be secured and the cutter jam may be resolved easily and securely.

DETAILED DESCRIPTION OF THE PREFERRED EMBODIMENTS

Preferred embodiments of a printer according to the present invention will be described in detail with reference to the accompanying drawings. In these embodiments, applications of a printer apparatus that includes a printer according to the present invention will be exemplified.

(Embodiment)

Figure 1:
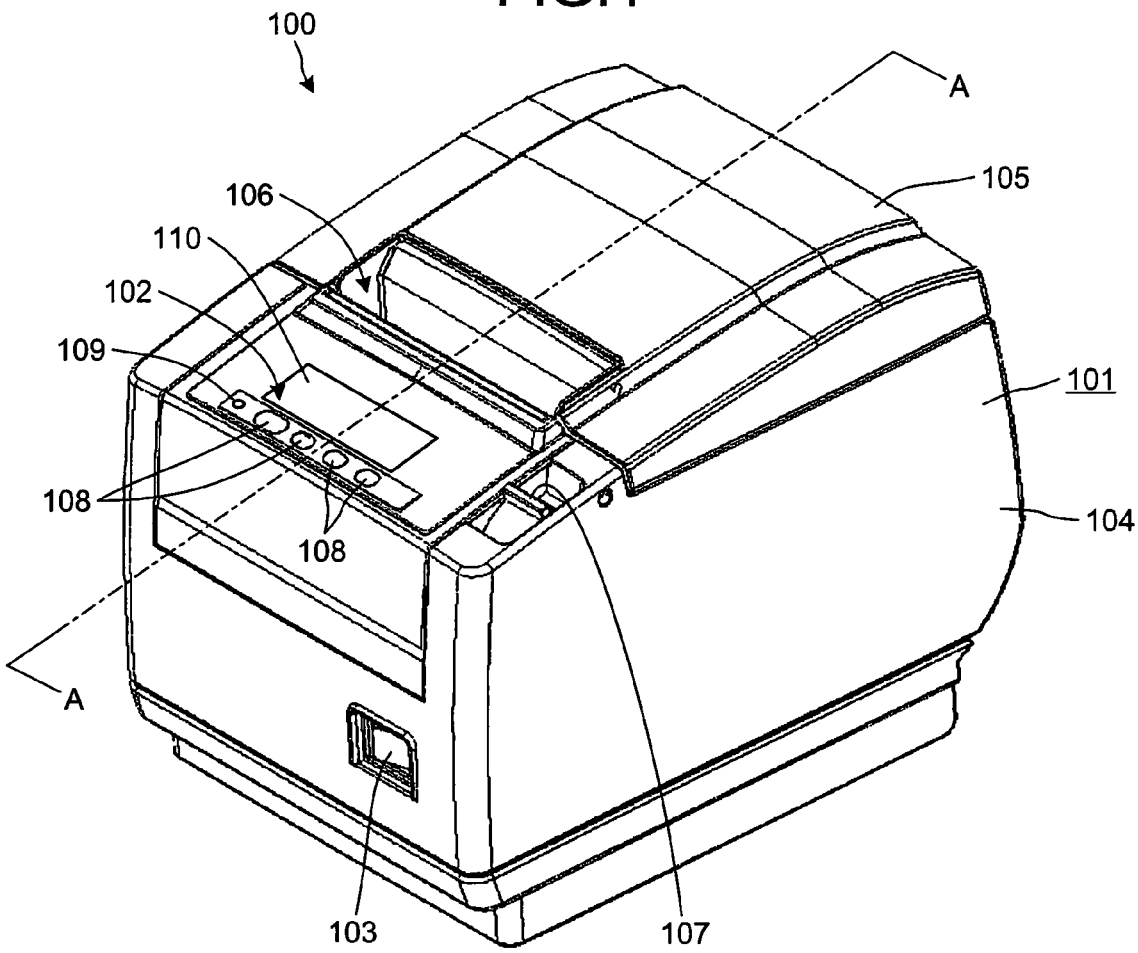
FIG. 1 is a diagram depicting a printer apparatus according to an embodiment of the present invention (part 1)
Figure 2:
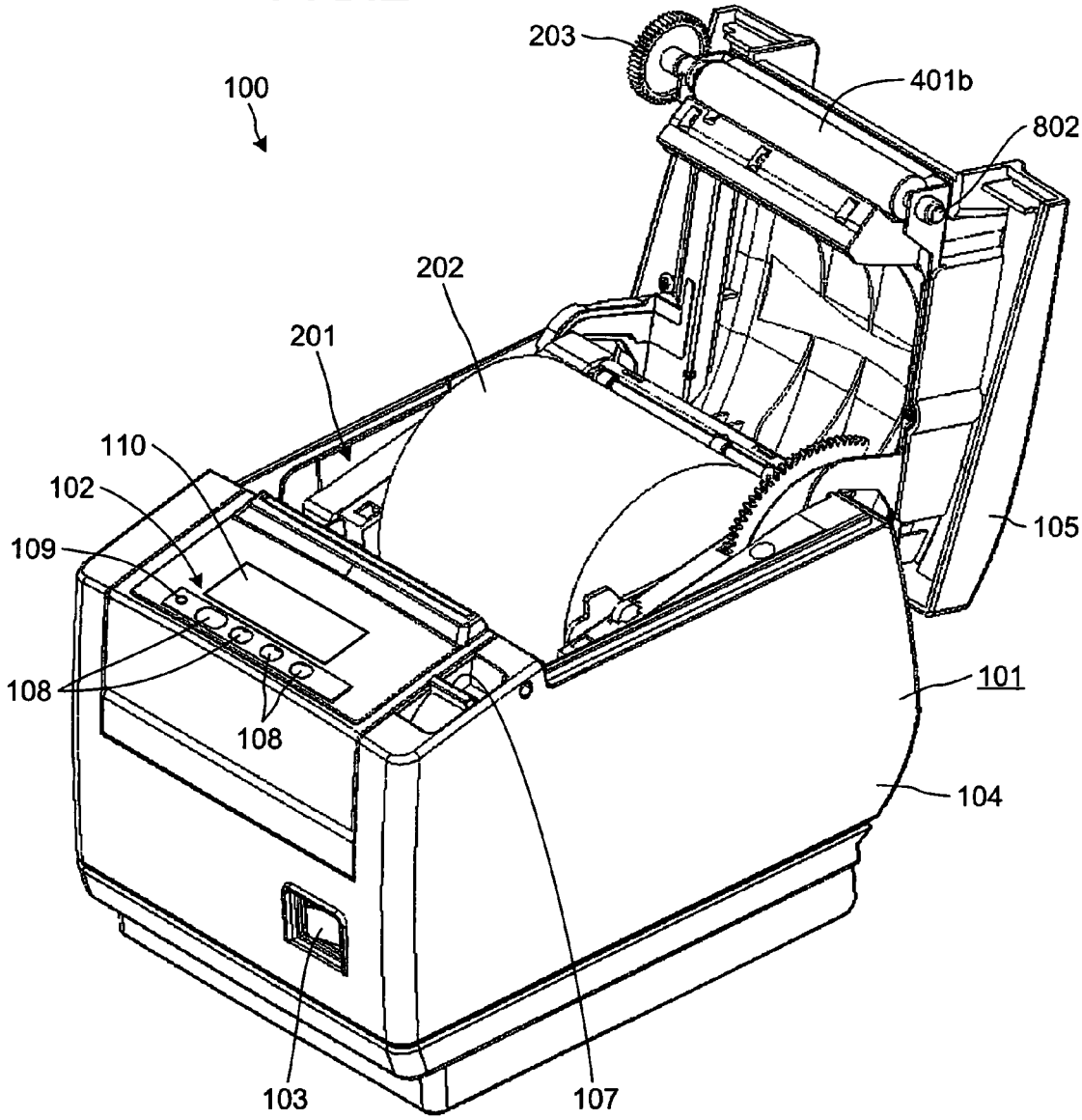
FIG. 2 is a diagram depicting the printer apparatus according to the embodiment of the present invention (part 2)
Figure 3:
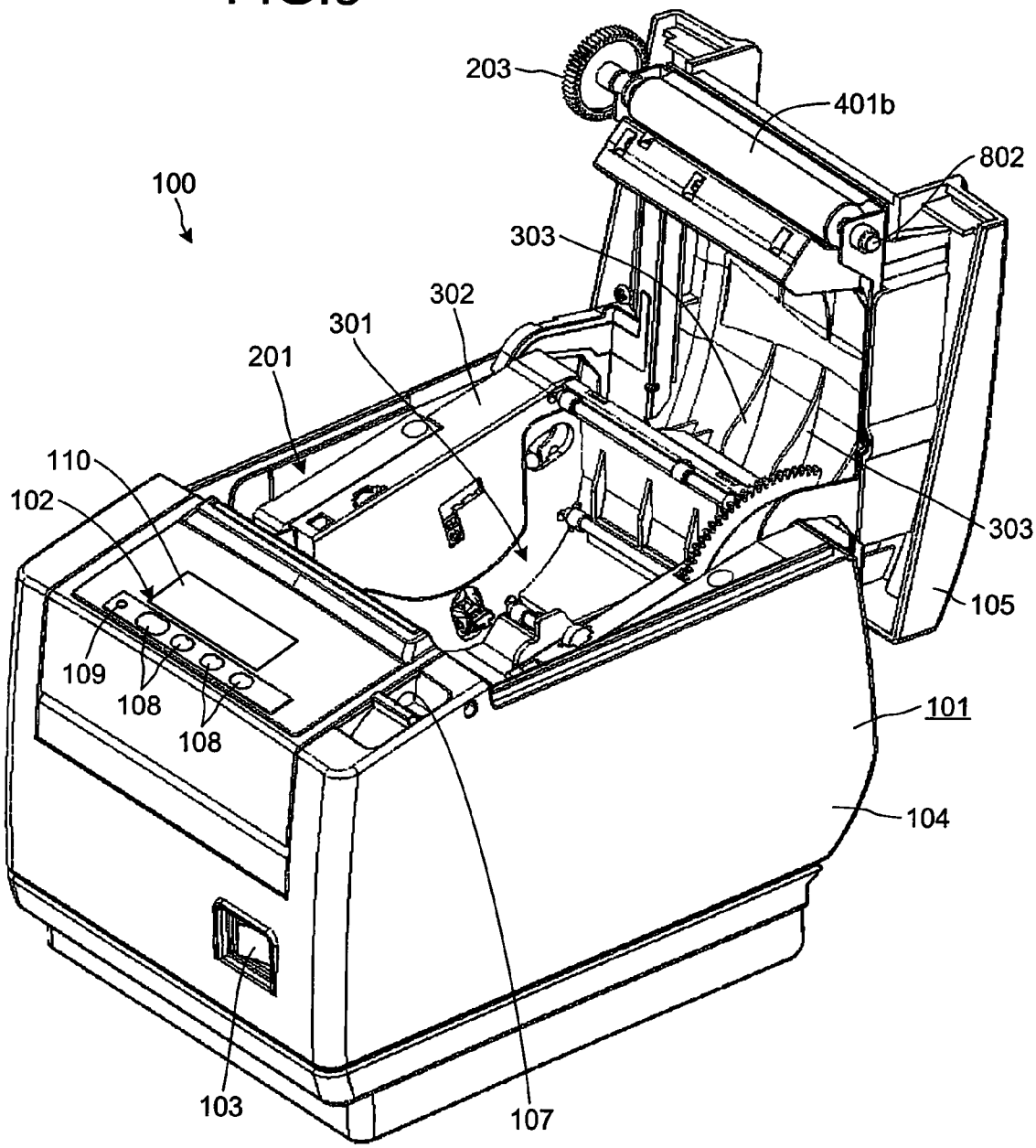
FIG. 3 is a diagram depicting the printer apparatus according to the embodiment of the present invention (part 3)
Figure 4:
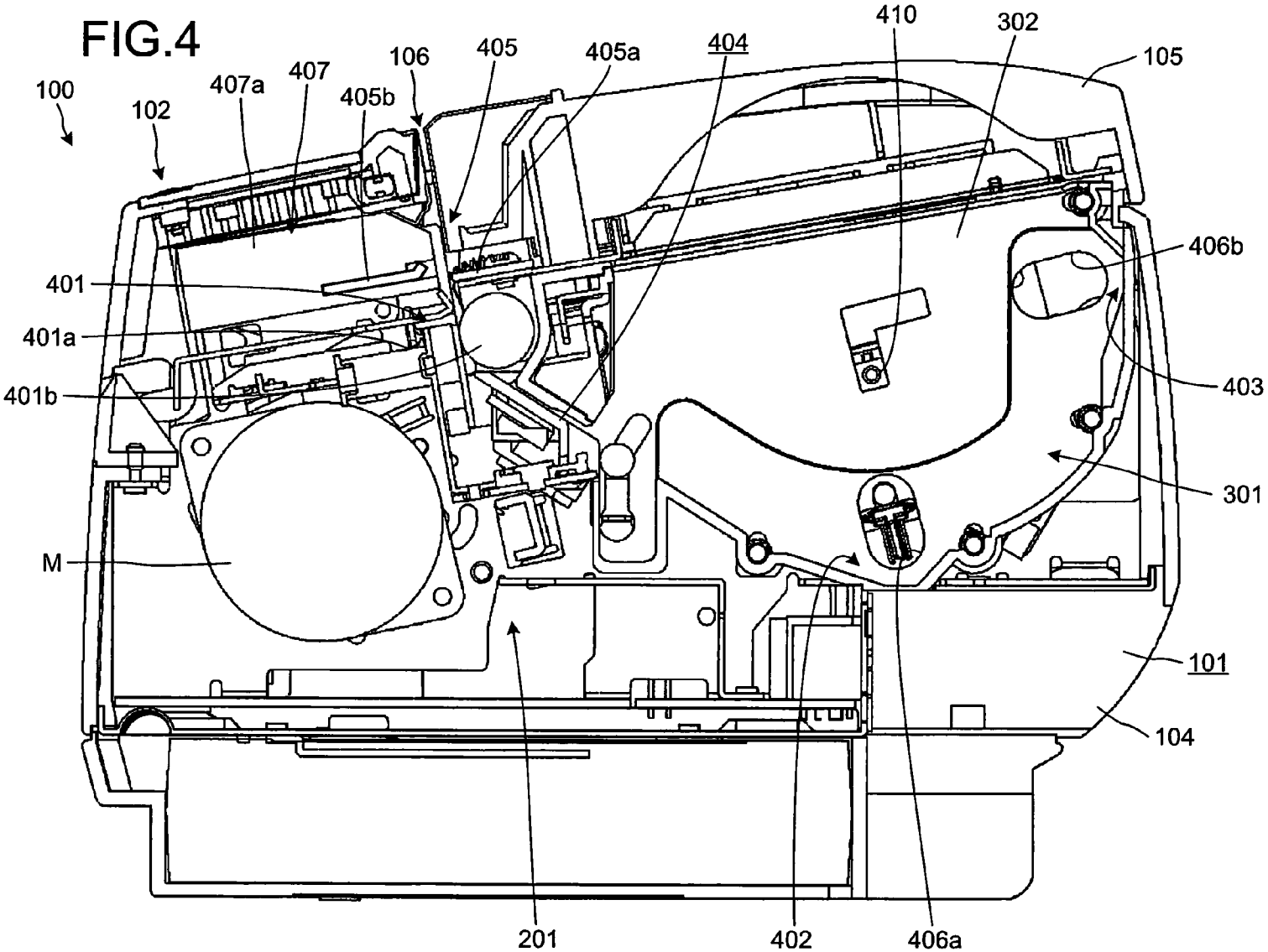
FIG. 4 is a diagram depicting the printer apparatus according to the embodiment of the present invention (part 4)

A printer apparatus according to an embodiment of the present invention will be described. FIGS. 1 to 4 are diagrams for explaining the printer apparatus according to the embodiment of the present invention. FIGS. 1 to 3 are diagrams depicting external views of the printer apparatus according to the embodiment of the present invention. FIG. 4 depicts a cross section (along an A-A line in FIG. 1) of the printer apparatus according to the embodiment of the present invention.

In FIGS. 1 to 4, the printer apparatus 100 according to the embodiment of the present invention includes a casing 101 that has a substantially box shape. A printer 201 is provided inside the casing 101.

An operation panel 102 is provided at one aspect of the casing 101. The operation panel 102 is equipped with operation keys 108 for receiving various instructions for the printer apparatus 100, an LED lamp 109 that indicates the state of the printer apparatus 100, and a liquid crystal displaying unit 110 that indicates the state of the printer apparatus 100 using characters or symbols. A power switch 103 that switches the power of the printer apparatus 100 to ON and OFF is provided at another aspect of the casing 101.

The casing 101 includes a casing main body 104 that supports the printer 201, and a printer cover 105 that is coupled to the casing main body 104. The printer cover 105 is coupled to the casing main body 104 such that the interior of the casing main body 104 is enclosed and accessible via the printer cover 105.

When a cover opening lever 107 provided at a face of the casing 101 is operated, the printer cover 105 opens exposing the interior of the casing main body 104. In the embodiment, an operating unit may be implemented by the cover opening lever 107.

In the casing 101, a recording medium discharge opening 106 is formed by a gap formed between the casing main body 104 and the printer cover 105 when the interior of the casing main body 104 is enclosed by the printer cover 105. The recording medium discharge opening 106 communicatively connects the interior of the casing 101 to the outside thereof, and discharges therethrough the recording medium 202 on which printing is executed by a printing unit 401 included in the printer 201 housed in the casing 101, to the outside of the casing 101.

The printing unit 401 prints characters, etc., on the recording medium 202 conveyed from the recording medium accommodating unit 301 to the recording medium discharge opening 106. The printing unit 401 is not limited to one that prints characters, and may print items other than characters such as symbols, given logo marks, and other images. In the first embodiment, the printing unit 401 prints under a thermal printing scheme.

The printing unit 401 includes a printing head 401*a* and a platen 401*b*. The printing head 401*a* and the platen 401*b* are disposed facing each other sandwiching the recording medium conveyance path 404 therebetween. The recording medium conveyance path 404 is formed in the casing 101 in a state where the printer cover 105 encloses the interior of the casing main body 104. The recording medium conveyance path 404 communicatively connects the recording medium accommodating unit 301 to the recording medium discharge opening 106 starting from the recording medium accommodating unit 301 through the printing unit 401.

For example, the printing unit 401 that prints under a thermal printing scheme may include a thermal-printing-scheme printing head (thermal head) 401*a* and the platen 401*b*. The thermal-printing-scheme printing head (thermal head) 401*a*, for example, includes multiple heating elements arranged in a line along the width direction of the recording medium 202, selectively energizes each of the heating elements to selectively cause the heating elements to heat and thereby, prints characters, etc.

The printer 201 including the printing unit 401 that prints under a thermal printing scheme as described above uses the recording medium 202 that has a thermal color developing property. The thermal-printing-scheme printing head 401*a* and a control method of the printing head 401*a* may be implemented easily using various known techniques and therefore, will not be described.

The platen 401*b* has a substantially columnar shape having an axial center direction crossing the width direction of the recording medium 202 (a direction penetrating the paper hereof FIG. 4). An end of a shaft of the platen 401*b* is fitted with a gear 203. The gear 203 is rotated by a driving force transmitted to the gear 203 from a motor M that is provided in the casing main body 104. The platen 401*b* rotates with the rotation of the gear 203. The motor M and the gear 203 are engaged through a gear train 506 (see FIG. 5, 6, or 7).

The platen 401*b* faces the printing head 401*a* sandwiching therebetween the recording medium 202 that is conveyed in the recording medium conveyance path 404, and during printing, supports the recording medium 202 from a back surface against a printing force induced by the printing head 401*a*. The platen 401*b* conveys the printed recording medium 202 from the recording medium accommodating unit 301 to the recording medium discharge opening 106 by rotating about the axial center.

The recording medium accommodating unit 301 that accommodates the recording medium 202 is provided inside the casing 101. The recording medium 202 has a long strip-shape, is accommodated in the recording medium accommodating unit 301 being wound around a core from one end in the longitudinal direction. When the printer cover 105 is moved in a direction causing the printer cover 105 to open, the recording medium accommodating unit 301 is opened to the exterior. When the recording medium accommodating unit 301 is opened, the recording medium 202 wound in a roll may be accommodated in the recording medium accommodating unit 301 and the recording medium 202 accommodated in the recording medium accommodating unit 301 may be removed from the recording medium accommodating unit 301.

The recording medium accommodating unit 301 is implemented by a box-shaped member 302 supported by a main body frame 503 (see, e.g., FIGS. 5 and 6) of the printer 201. The box-shaped member 302 includes a bottom portion that is curved in a substantially semi-circular shape, and has a shape of which one aspect facing the bottom portion is open. The printer cover 105 has an accommodating unit rib 303 that faces the box-shaped member 302 and that protrudes from the printer cover 105 toward the box-shape member 302.

When the printer cover 105 is closed, the accommodating unit rib 303 forms, together with the box-shape member 302, the recording medium accommodating unit 301 whose cross section is substantially circular. The bottom portion of the recording medium accommodating unit 301 is curved at a curvature that is equal to or larger than that of the maximal outer diameter of the recording medium 202 wound in a roll and accommodated in the recording medium accommodating unit 301. The recording medium 202 wound in a roll is supported from the bottom portion.

The recording medium accommodating unit 301 includes a first recording medium holding unit 402 that holds the recording medium 202 when the printer 201 is in a first installation state, and a second recording medium holding unit 403 that holds the recording medium 202 when the printer 201 is in a second installation state that is different from the first installation state. In the embodiment, the first and the second recording medium holding units 402 and 403 may be implemented by a portion of the bottom portion included in the box-shaped member 302.

In the embodiment, a state where the printer apparatus 100 is installed with the recording medium discharge opening 106 facing vertically upward in the printer apparatus 100 is defined as the first installation state, and a state where the printer apparatus 100 is installed with the recording medium discharge opening 106 being in an orientation that crosses the vertical orientation, i.e., being oriented forward toward the user of the printer 201, is defined as the second installation state.

When the printer 201 is in the first installation state, the recording medium 202 wound in a roll is moved to be received at a lower end of a curved aspect formed by the first recording medium holding unit 402, by the weight of the recording medium 202 as the recording medium 202 is consumed. When the printer 201 is in the second installation state, the recording medium 202 wound in a roll is moved to be received at a lower end of the curved aspect formed by the second recording medium holding unit 403, by the weight of the recording medium 202 as the recording medium 202 is consumed.

The recording medium 202 wound in a roll and accommodated in the recording medium accommodating unit 301 is pulled out starting from an outer circumference and is fed to the printing unit 401 by the rotation of the platen 401*b* to send out the recording medium 202, unrolling toward the recording medium discharge opening 106. The recording medium 202 wound in a roll is rotated in the recording medium accommodating unit 301 by being pulled out starting from the outer circumference. In the recording medium accommodating unit 301, the recording medium 202 wound in a roll is rotated about the core part around which the recording medium 202 is wound into a roll.

Therefore, in a state where the recording medium 202 wound in a roll can be rotated about the core part of the recording medium 202, the recording medium accommodating unit 301 accommodates and holds the recording medium 202 wound in a roll. When the recording medium 202 wound in a roll is accommodated in the recording medium accommodating unit 301, the recording medium 202 is held from below in the vertical direction by the first recording medium holding unit 402 or the second recording medium holding unit 403, according to the installation state.

The printer 201 includes a remaining amount detecting mechanism that detects (senses) the remaining amount of the recording medium 202 wound in a roll and accommodated in the recording medium accommodating unit 301. The remaining amount detecting mechanism includes a first detecting unit that detects the remaining amount of the recording medium 202 wound in a roll and held in the first recording medium holding unit 402, and a second detecting unit that detects the remaining amount of the recording medium 202 wound in a roll and held in the second recording medium holding unit 403. In the printer 201 according to the present embodiment, the first and the second detecting units are provided such that detection by only one of them is activated.

The printer 201 includes a switching lever 410 that receives switching operations to switch the state of the remaining amount detecting mechanism such that detection by any one among the first and the second detecting units is activated. Which one of the first and the second detecting units is activated is determined by the user of the printer apparatus 100, according to the installation state of the printer apparatus 100, i.e., the printer 201.

The user of the printer apparatus 100 switches the state of the remaining amount detecting mechanism by operating the switching lever 410 according to the installation state of the printer apparatus 100, i.e., the printer 201, such that any one among the first and the second detecting units is activated. In the printer apparatus 100, the state of the remaining amount detecting mechanism may be switched by operating the switching lever 410 such that detection by both the first and the second detecting units is deactivated.

The remaining amount detecting mechanism is provided in the casing main body 104 and external to the recording medium accommodating unit 301. The first detecting unit in the remaining amount detecting mechanism detects the remaining amount of the recording medium 202 wound in a roll and held in the first recording medium holding unit 402, through a first window 406*a* provided in the recording medium accommodating unit 301.

The second detecting unit in the remaining amount detecting mechanism detects the remaining amount of the recording medium 202 wound in a roll and held in the second recording medium holding unit 403, through a second window 406*b* provided in the recording medium accommodating unit 301. FIG. 4 depicts a state where the first detecting unit is activated.

More specifically, the remaining amount detecting mechanism detects the remaining amount of the recording medium 202 to be, or not to be, the predetermined amount or less by detecting the position of the core part based on an assumption that the number of turns of the recording medium 202 wound in a roll decreases as the recording medium 202 is consumed and concurrently, the diameter of the recording medium 202 becomes smaller; whereby, the core part moves.

In the recording medium conveyance path 404, a cutting mechanism 405 is provided at a position that is closer to the recording medium discharge opening 106 than the printing unit 401, i.e., downstream in the recording medium conveyance direction. The cutting mechanism 405 includes a fixed blade 405*a* whose position is fixed and a movable blade 405*b* that is provided at a position at which the movable blade 405*b* faces the fixed blade 405*a* sandwiching the recording medium conveyance path 404 therebetween. The fixed blade 405*a* is provided on the printer cover 105.

The movable blade 405*b* is provided facing the fixed blade 405*a* and freely reciprocates relative to the fixed blade 405*a* when the cover unit (see, e.g., FIGS. 5 and 6) of the printer 201 is closed. When the movable blade 405*b* reciprocates, the movable blade 405*b* slides such that an aspect (on the upstream side in the recording medium conveyance direction) of the movable blade 405*b* contacts an aspect (on the downstream side in the recording medium conveyance direction) of the fixed blade 405*a*.

Thereby, the movable blade 405*b* overlaps the downstream side of the fixed blade 405*a* in the recording medium conveyance direction when the moving direction of the movable blade 405*b* is changed from a forward moving direction to a backward moving direction. When the movable blade 405*b* reciprocates by sliding as described above, the movable blade 405*b*, in concert with the fixed blade 405*a*, cuts the recording medium inserted between the fixed blade 405*a* and the movable blade 405*b*. Thereby, the recording medium 202 on which printing has been executed by the printing unit 401 is cut at an arbitrary length by the cutting mechanism 405.

A driving force of a movable blade driving motor, not depicted, is transmitted to the movable blade 405*b* and thereby, the movable blade 405*b* is caused to reciprocate. In the embodiment, a movable blade driving unit may be implemented by the movable blade driving motor. The movable blade 405*b* and the movable blade driving motor are configured as a unit together with an accommodating unit 407*a* that accommodates the movable blade 405*b*, and constitute a movable blade unit 407. The accommodating unit 407*a* in the movable blade unit 407 includes, for example, an opening that allows the movable blade 405*b* to protrude and may be implemented by a substantially box-shaped member that forms a space capable of accommodating the movable blade 405*b*.

The movable blade unit 407 is provided at the main body frame 503 of the printer 201. The movable blade unit 407 provided at the main body frame 503 of the printer 201 is detachable (attachable to and detachable) from the main body frame 503. Thereby, when the movable blade 405*b* is worn or when any of mechanism components such as the motor to move the movable blade 405*b* become aged, the movable blade 405*b* and the motor can be replaced easily by replacement of the movable blade unit 407.

After cutting the recording medium 202, the cutting mechanism 405 moves the movable blade 405*b* in a direction causing the movable blade 405*b* to move away from the fixed blade 405*a* and forms a gap between the fixed blade 405*a* and the movable blade 405*b*. By a rotation of the platen 401*b* in this state, the recording medium 202 accommodated in the recording medium accommodating unit 301 is sent out being unrolled toward the recording medium discharge opening 106. Thereby, the recording medium may be subjected to the next printing.

Figure 5:
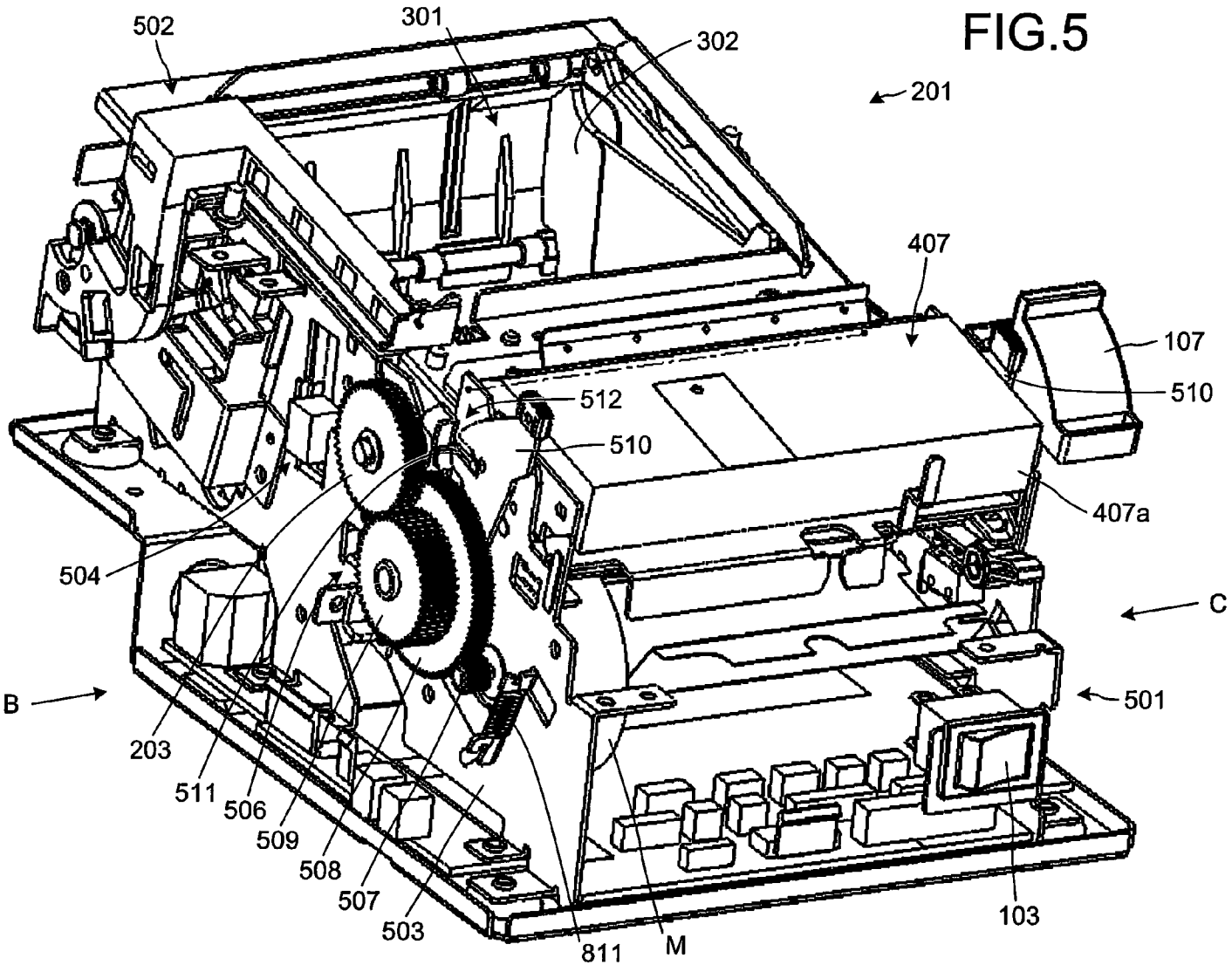
FIG. 5 is a diagram for explaining a printer included in the printer apparatus of the embodiment according to the present invention (part 1)
Figure 6:
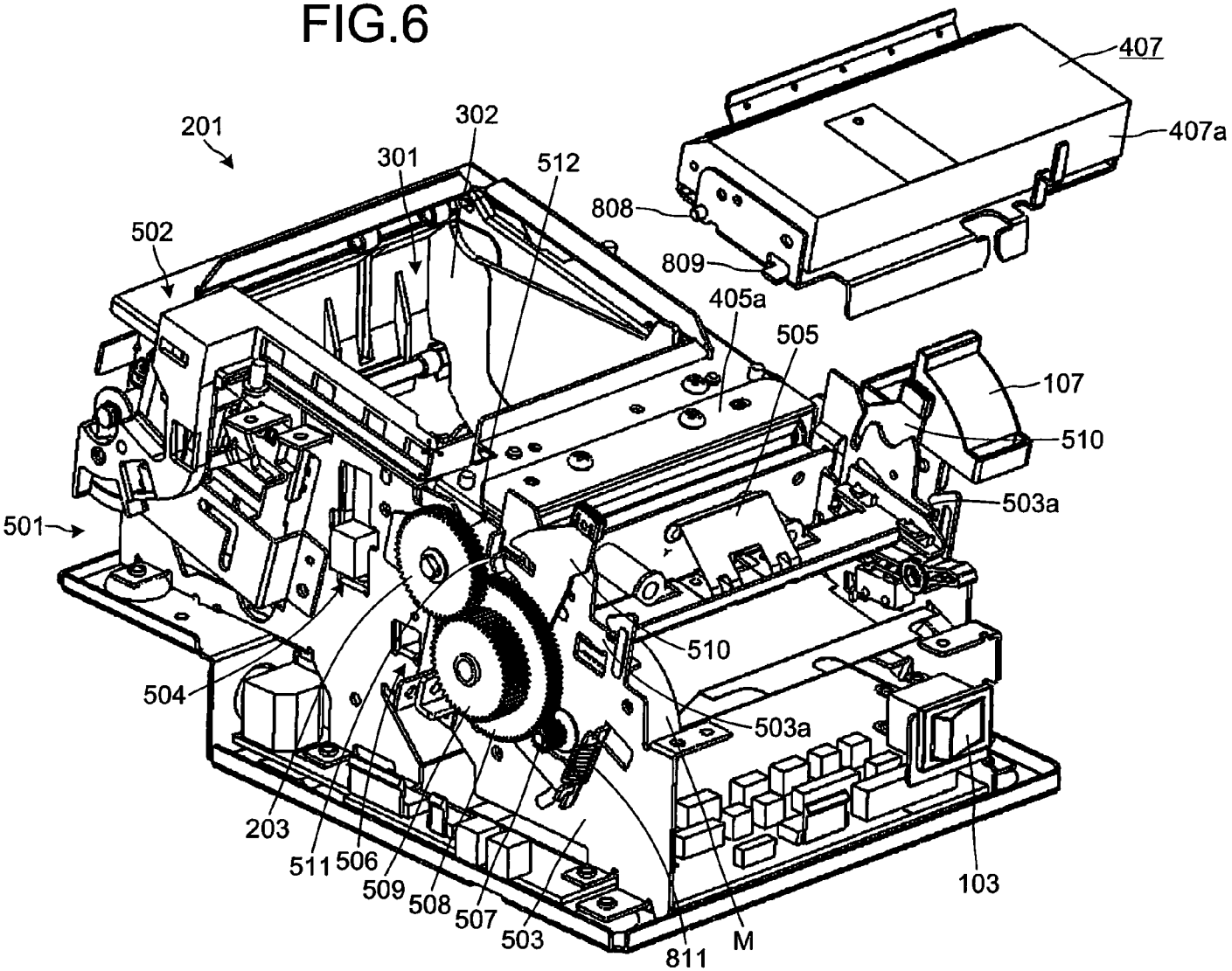
FIG. 6 is a diagram for explaining the printer included in the printer apparatus of the embodiment according to the present invention (part 2)
Figure 7:
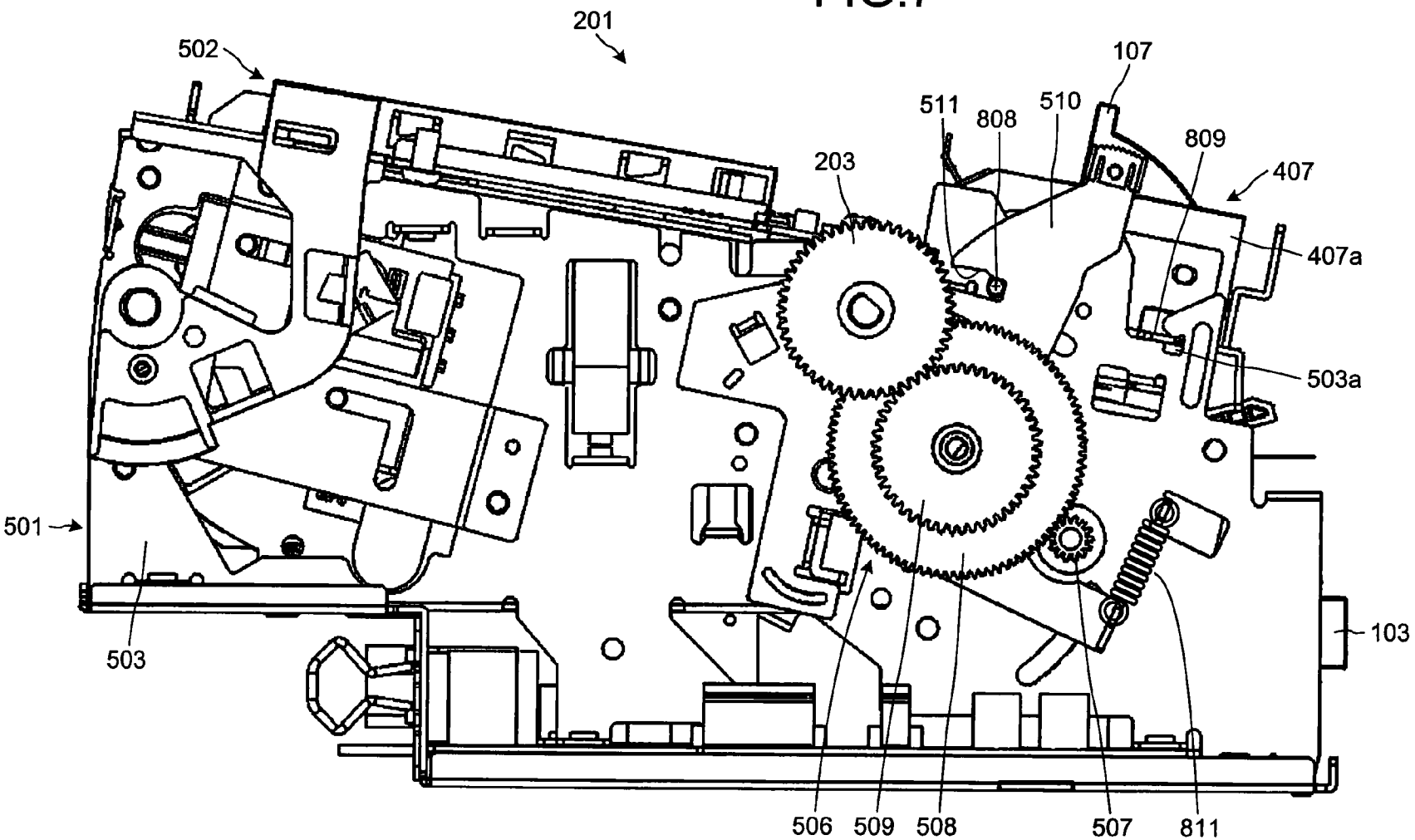
FIG. 7 is a diagram for explaining the printer included in the printer apparatus of the embodiment according to the present invention (part 3)
Figure 8:
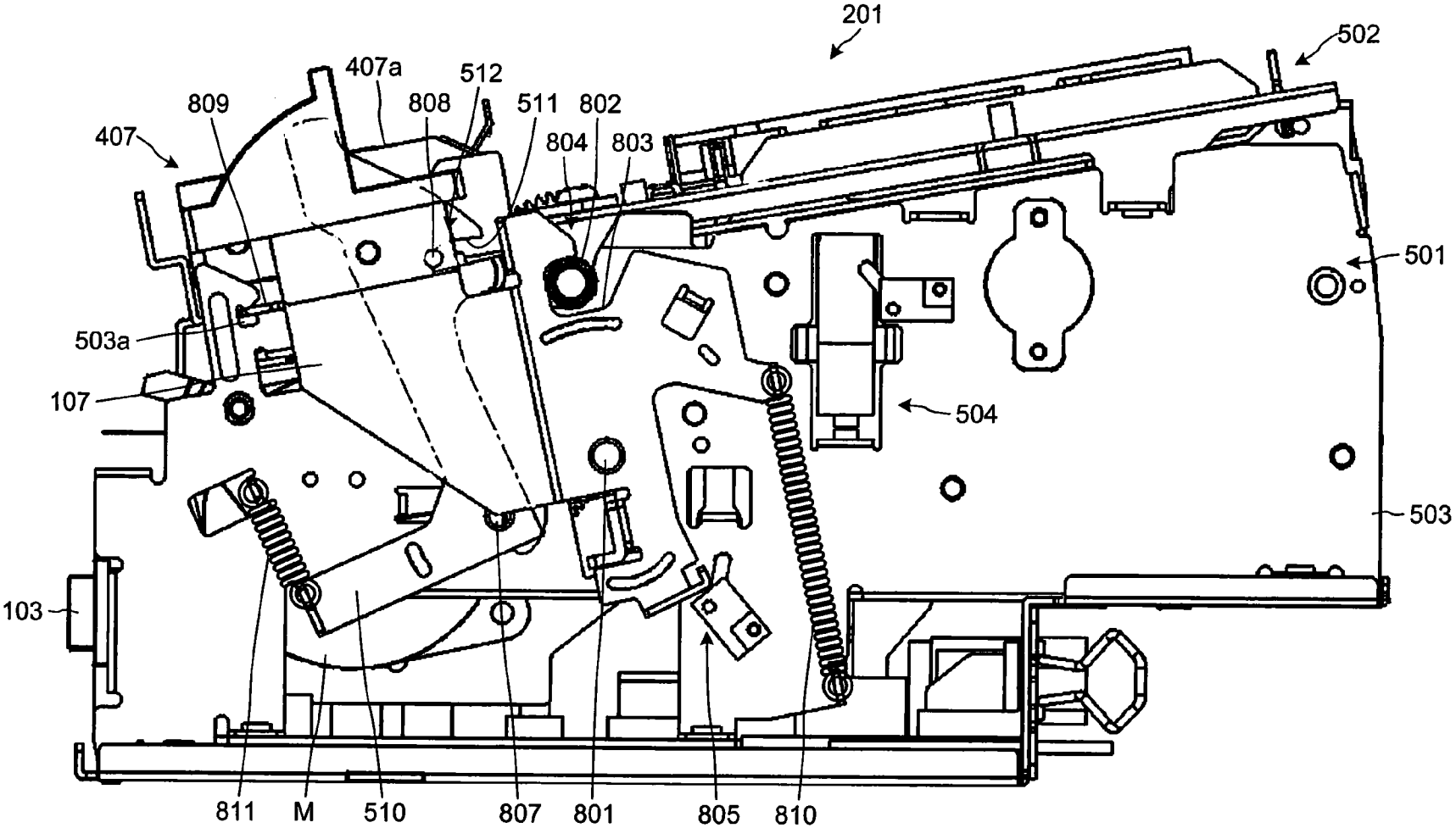
FIG. 8 is a diagram for explaining the printer included in the printer apparatus of the embodiment according to the present invention (part 4)

The printer included in the printer apparatus of the embodiment according to the present invention will be described. FIGS. 5 to 8 are diagrams for explaining the printer included in the printer apparatus of the embodiment according to the present invention. FIG. 5 depicts a view of the printer according to the embodiment of the present invention as viewed from an oblique direction. FIG. 6 depicts a view of a disassembled portion of the printer according to the embodiment of the present invention as viewed from an oblique direction. FIG. 7 is a side view of the printer according to the embodiment of the present invention as viewed from a direction indicated by an arrow B in FIG. 5. FIG. 8 depicts a side view of the printer according to the embodiment of the present invention as viewed from a direction indicted by an arrow C in FIG. 5.

In FIGS. 5 to 8, the printer 201 is provided inside the casing 101 and includes a printer main body 501 and a cover unit 502. The printer main body 501 includes a main body frame 503 that supports the casing main body 104. The cover unit 502 is rotatably attached to the main body frame 503. The cover unit 502 rotates relative to the main body frame 503 and thereby, covers the recording medium accommodating unit 301 and is capable of being opened. The printer cover 105, interlocked with the cover unit 502 being capable of being opened, closes the recording medium accommodating unit 301. The cover unit 502 is biased by a biasing mechanism 504 in the direction to open the recording medium accommodating unit 301.

The cover opening lever 107 is coupled to the main body frame 503 through a shaft portion 801. The cover opening lever 107 is provided being rotatable about the shaft 801 and along the main body frame 503. The cover opening lever 107 has a cutout 803 that, when the cover unit 502 covers the main body frame 503, i.e., when the printer cover 105 closes the interior of the casing main body 104, engages with a boss 802 that is for locking and provided on the cover unit 502.

When the cutout 803 of the cover opening lever 107 engages with the boss 802 provided on the cover unit 502, the cover opening lever 107 positions the cover unit 502 at a position causing the cover unit 502 to close the recording medium accommodating unit 301, resisting the biasing mechanism 504. Thereby, when the cover unit 502 is closed, the cover unit 502 may be locked to the printer main body 501. The cover opening lever 107 is biased by a coil spring 810 in the direction that the boss 802 for locking and provided on the cover unit 502 moves to engage with the cutout 803.

The coil spring 810 has one end locked to the main body frame 503 and the other end locked to the cover opening lever 107. Thereby, the cover opening lever 107 is biased in the direction that the cutout 803 of the cover opening lever 107 moves to engage with the boss 802 for locking and provided on the cover unit 502.

The cover unit 502 is biased in a direction to open the recording medium accommodating unit 301 and therefore, the cutout 803 of the cover opening lever 107 and the boss 802 provided at the cover unit 502 are engaged stably and thus, the position of the cover unit 502 is stabilized. In the embodiment, a cover unit locking mechanism 804 includes the boss 802 provided on the cover unit 502, the cutout 803 of the cover opening lever 107, and the cover opening lever 107.

When the cover opening lever 107 rotates about the shaft portion 801 and the engagement between the cover opening lever 107 and the boss 802 is disengaged, the cover unit 502 is biased by a biasing force of the biasing mechanism 504 and is rotated in a direction to open the recording medium accommodating unit 301. The main body frame 503 has a cover opening switch 805 that detects the rotation of the cover unit 502 in the direction to open the recording medium accommodating unit 301 (hereinafter, "opening direction" as appropriate). Output of the cover opening switch 805 changes when the cover unit 502 rotates in the opening direction.

The printer 201 includes a control unit, not depicted, that drives and controls the components included in the printer 201. The control unit is provided in the casing 101 of the printer apparatus 100 and may be implemented by, for example, a micro computer that includes memories such as a ROM and a RAM, and a CPU.

The control unit detects the rotation of the cover unit 502 in the opening direction (hereinafter, "cover open" as appropriate) based on an output signal from the cover opening switch 805. The control unit drives and controls the motor M and the movable blade driving motor included in the movable blade unit 407.

A cutter lever 510 is provided between the cover opening lever 107 and an outer face of the main body frame 503. The cutter lever 510 is provided being rotatable about a shaft portion 807 that couples the cutter lever 510 to the main body frame 503 (see FIG. 8).

The cutter lever 510 has a cutout 511 that engages with a protrusion 808 provided on a side aspect (of the movable blade unit 407) that is close to the fixed blade 405*a* when the cutout 803 of the cover opening lever 107 engages with the boss 802 provided in the casing main body 104 (hereinafter, "cover locked state" as appropriate).

When the cutout 511 of the cutter lever 510 engages with the protrusion 808 provided on the movable blade unit 407, the cutter lever 510 positions the movable blade unit 407 at a position enabling the fixed blade 405*a* and the movable blade 405*b* to cooperatively cut the recording medium 202.

In the embodiment, a movable blade unit locking mechanism 512 includes the cutout 511 of the cutter lever 510, the protrusion 808 provided on the movable blade unit 407, and the cutter lever 510. The cutter lever 510 is biased by a coil spring 811 in the direction that the cutout 511 moves to engage with the protrusion 808 provided on the movable blade unit 407.

The coil spring 811 has one end locked to the main body frame 503 and the other end locked to the cutter lever 510. Thereby, the cutter lever 510 is biased in the direction that the cutout 511 of the cutter lever 510 moves to engage with the protrusion 808 of the movable blade unit 407.

A protrusion 809 that engages with a cutout 503*a* provided in the main body frame 503 is provided at a side aspect away from the fixed blade 405*a* of the movable blade unit 407. The movable blade unit 407 is fixed to the main body frame 503 by engaging the protrusion 809 with the cutout 503*a* provided in the main body frame 503 and by engaging the protrusion 808 with the cutout 511 provided in the cutter lever 501.

The movable blade unit 407 is biased, by a biasing member 505 implemented by a plate spring, in a downstream conveyance direction of the recording medium 202. Thereby, the cutout 511 of the cutter lever 510 and the protrusion 808 provided on the movable blade unit 407 are engaged stably; whereby, the position of the movable blade unit 407 is stabilized.

The cutout 511 of the cutter lever 510 has a two-step shape such that steps therein are formed on the open end side downstream in the conveyance direction of the recording medium 202 toward the depth thereof. Thereby, when the cutter lever 510 is rotated about the shaft portion 807 in the direction for the engagement between the cutout 511 of the cutter lever 510 and the protrusion 808 of the movable blade unit 407 to be disengaged (hereinafter, "unit lock releasing direction" as appropriate), before the engagement between the cutout 511 of the cutter lever 510 and the protrusion 808 of the movable blade unit 407 is completely disengaged, the state of the engagement between the cutout 511 and the protrusion 808 changes and, the movable blade unit 407 is biased by the biasing member 505 and is displaced downstream in the conveyance direction of the recording medium 202.

When the movable blade unit 407 is displaced downstream in the conveyance direction of the recording medium 202, the movable blade 405*b* being protruded from the accommodating unit 407*a* and the fixed blade 405*a* face each other having a predetermined space therebetween. It is sufficient for the predetermined space to be a space is wider than the positional relation of the fixed blade 405*a* and the movable blade 405*b* for cooperative cutting of the recording medium 202 and preferably, the predetermined space is a space wider than the thickness of the recording medium 202.

The position of the movable blade unit 407 enabling the fixed blade 405*a* and the movable blade 405*b* to cooperatively cut the recording medium 202 will be referred to as a first position in the description below. The position of the movable blade unit 407 causing the movable blade 405*b* protruding from the accommodating unit 407*a* and the fixed blade 405*a* to face each other sandwiching the predetermined space therebetween downstream of the first position will be referred to as a second position in the description below.

In the main body frame 503, another cutter lever 510 is also provided on the side opposite to the side on which the cover opening lever 107 is provided. The cutter levers 510 have the same shapes on both sides of the main body frame 503 and are rotatably coupled to the main body frame 503 through the shaft portion 807. The cutter lever 510 and the other cutter lever 510 are independently and rotatably provided. Similar to the cutter lever 510, the other cutter lever 510 is biased by the coil spring 811 in a direction to engage with the protrusion 808.

In the main body frame 503, a gear train 506 coupling the gear 203 to the motor M is provided on the side on which the other cutter lever 510 is provided. The gear train 506 includes a motor gear 507 provided at a driving shaft of the motor M, a first gear 508 engaged with the motor gear 507, and a third gear 509 that is formed integrated with the first gear 508 and that is engaged with the gear 203. In the printer main body 501, the cutter levers 510 are provided between the gear train 506 and an outer aspect of the main body frame 503.

Each of the cutter levers 510 is provided being rotatable, interlocked with the rotation of the cover opening lever 107. When the cover opening lever 107 is rotated in the direction for the engagement between the cutout 803 and the boss 802 to be disengaged, i.e., the opening direction, each of the cutter levers 510 is rotated in the direction for the engagement between the cutout 511 and the protrusion 808 to be disengaged with the rotation of the cover opening lever.

When the cover opening lever 107 is released from an external force that rotates the cover opening lever 107 in the opening direction, the cover opening lever 107 is rotated in the direction opposite to the opening direction by the biasing force of the coil spring 810 that biases the cover opening lever 107. When each of the cutter levers 510 is released from the external force applied by the rotation of the cover opening lever 107, each of the cutter levers 510 is rotated by the biasing force of the coil spring 811 that biases the cutter lever 510, in the direction for the cutout 511 and the protrusion 808 to be engaged with each other.

The range of the rotation of the cover opening lever 107 in the opening direction is set to be a range within which the engagement between the cutter levers 510 rotated in conjunction with the cover opening lever 107 and the protrusion 808 of the movable blade unit 407 is not disengaged.

When the movable blade unit 407 is detached from the main body frame 503, the two cutter levers 510 are both rotated in the unit lock releasing direction and thereby, the engagement between the cutout 511 of each of the cutter levers 510 and the protrusion 808 of the movable blade unit 407 is disengaged. When the engagement between the cutout 511 and the protrusion 808 is disengaged on both sides of the movable blade unit 407, the movable blade unit 407 is biased by the biasing member 505 and is displaced such that the movable blade unit 407 ascends from the main body frame 503. Thereby, the movable blade unit 407 becomes easy to grab and therefore, reduction of the load on an operator who executes replacement operation for the movable blade unit 407 is facilitated.

By the configuration above, when an operator rotates the cover opening lever 107 in the opening direction, the movable blade unit 407 is prevented from being detached from the main body frame 503 due to unintentional disengagement of the engagement between the cutout 511 of each of the cutter levers 510 and the protrusion 808 of the movable blade unit 407.

By the configuration above, the movable blade unit 407 can be replaced by a one-touch operation without the use of any tools. Thereby, simplification of the replacement operation for the movable blade unit 407 is facilitated and reduction of the load on the operator who executes the replacement operation is facilitated.

The movable blade 405*b*, the movable blade driving motor, etc., may be detached and replaced as a unit, i.e., the movable blade unit 407, and therefore, after the movable blade unit 407 is detached, simplification of the operation related to the printing head 401*a* disposed immediately beneath the movable blade unit 407 may be facilitated, and simplification of the replacement operation of the printing head 401*a* and reduction of the load on the operator who executes the replacement operation may be facilitated.

The cutting mechanism 405 cuts the recording medium 202 by sliding the movable blade 405*b* relative to the fixed blade 405*a* and therefore, a state may occur where the recording medium 202 becomes caught between the fixed blade 405*a*, restricting and locking the movable blade 405*b*, i.e., so-called cutter jam.

When cutter jam occurs, both the fixed blade 405*a* and the movable blade 405*b* are caused to push each other by the recording medium 202 caught between the fixed blade 405*a* and the movable blade 405*b*, and the movable blade 405*b* is locked being unable to move forward or backward. In this state, even when the driving motor is driven, the movable blade 405*b* (cutter) is unable to act and therefore, an operator opens the printer cover 105 and executes operation to resolve the cutter jam.

(Operation to Resolve Cutter Jam)

Figure 9:
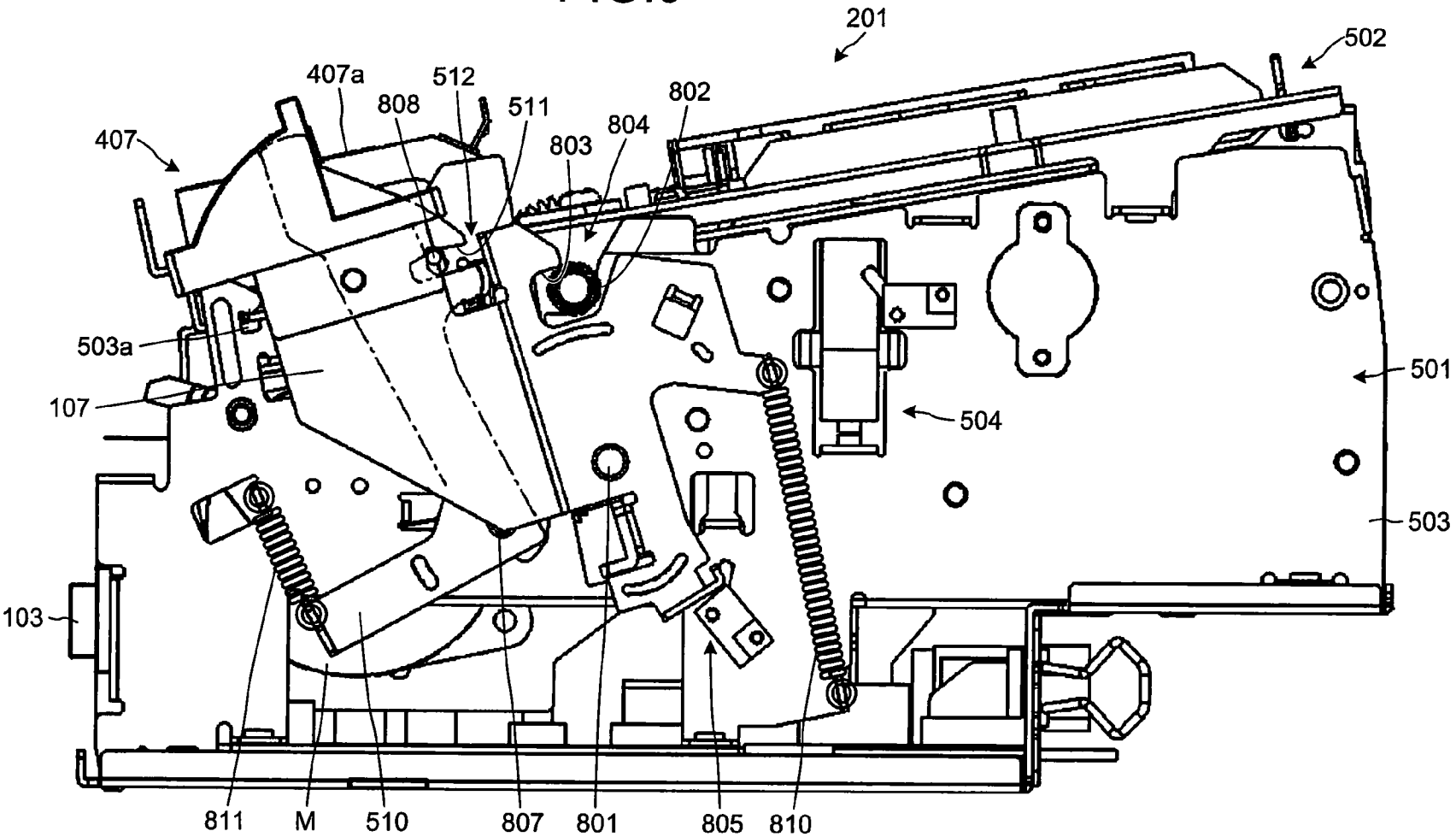
FIG. 9 is a diagram for explaining operation to resolve cutter jam (part 1)
Figure 10:
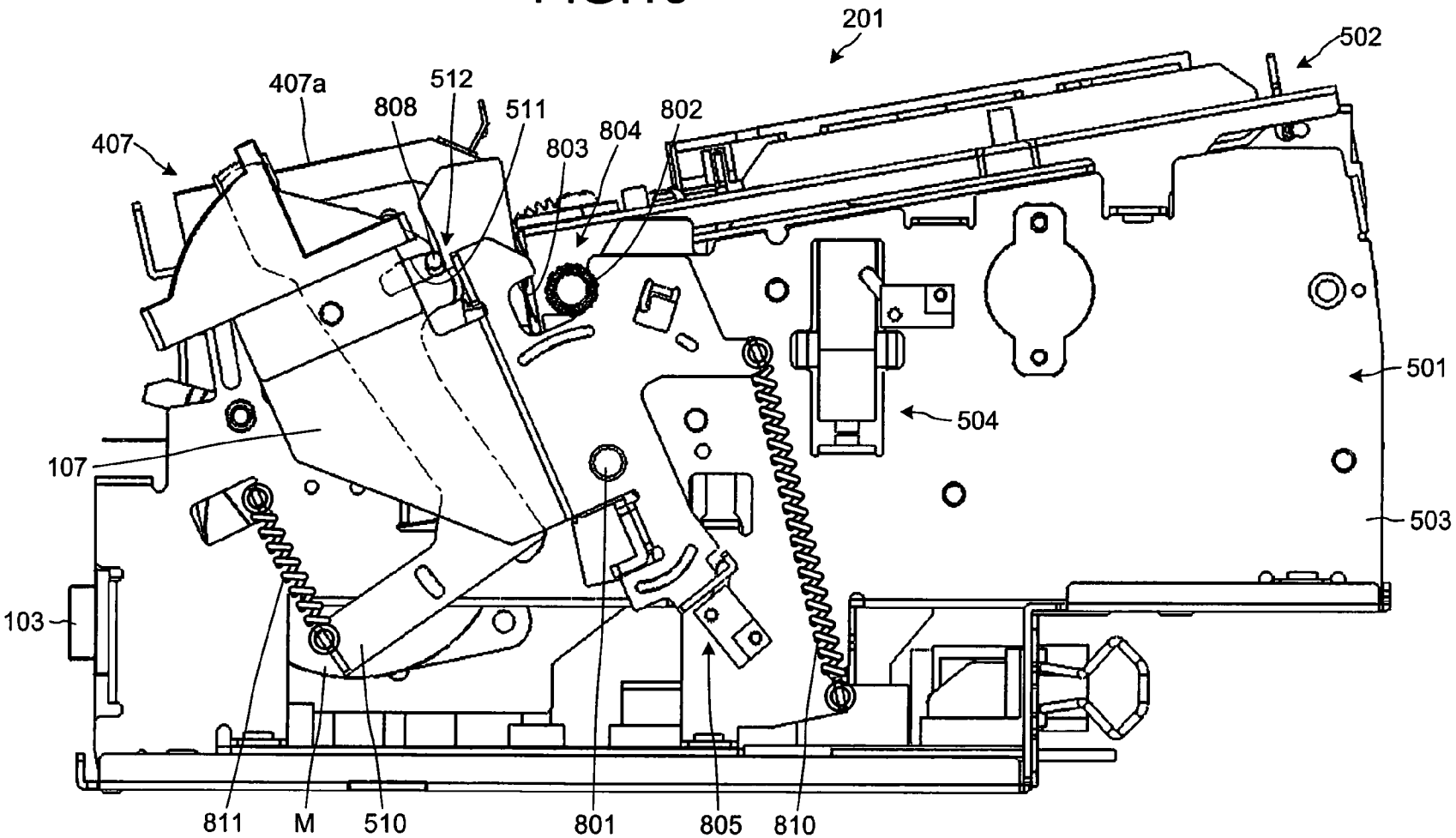
FIG. 10 is a diagram for explaining the operation to resolve cutter jam (part 2).

An operation of the printer when cutter jam is resolved in the printer 201 according to the embodiment of the present invention will be described. FIGS. 9 and 10 are diagrams for explaining operation to resolve cutter jam. The operation to resolve cutter jam will be described with reference to FIGS. 8 to 10.

In FIGS. 8 to 10, to resolve the cutter jam, an operator operates the cover opening lever 107 and thereby, rotates the cover opening lever 107 in the opening direction. The cover opening lever 107 is rotated in the opening direction and thereby, the output of the cover opening switch 805 changes. The control unit detects the opening of the cover unit 502 based on the change in the output of the cover opening switch 805.

From this state, when the cover opening lever 107 is further rotated in the opening direction, the engagement between the boss 802 provided in the casing main body 104 and the cutout 803 of the cover opening lever 107 is disengaged, and the cover unit 502 is biased by the biasing mechanism 504 and thereby, is rotated in the direction to open the recording medium accommodating unit 301.

The cover opening lever 107 is rotated in the opening direction and thereby, each of the cutter levers 510 is rotated in the unit lock releasing direction in conjunction with the rotation of the cover opening lever 107 in the opening direction. Each of the cutter levers 510 is rotated in the unit lock releasing direction and thereby, the state of the engagement between the cutout 511 of each of the cutter levers 510 and the protrusion 808 of the movable blade unit 407 changes due to the two-step configuration of the cutout 511. Thereby, the movable blade unit 407 is moved downstream from the first position and is positioned at the second position.

At this time, the movable blade unit 407 is biased by the biasing member 505, and a side close to the fixed blade 405*a* is rotated toward downstream using, as the fulcrum of the rotation, the engaged portion of the protrusion 509 provided at a side aspect (of the movable blade unit 407) that is away from the fixed blade 405*a* and the cutout 503*a* provided at the main body frame 503. Thereby, the movable blade unit 407 is moved from the first position to the second position.

When the control unit detects the change in the output of the cover opening switch 805, the control unit drives and controls the motor in the movable blade unit 407 in the direction for the movable blade 405*b* to be accommodated in the accommodating unit 407*a* by the driving of the motor. When the movable blade unit 407 is positioned at the second position, the movable blade 405*b* protruding from the accommodating unit 407*a* and the fixed blade 405 face each other sandwiching the predetermined space therebetween and therefore, even when cutter jam occurs, the movable blade 405*b* is accommodated securely in the accommodating unit 407*a*.

A mechanism is realized that widens the space over which the fixed blade 405*a* and the protruding movable blade 405*b* face each other before the cover opening lever 107 is operated and thereby, the movable blade driving motor accommodates the protruding movable blade 405*b*, in the accommodating unit 407*a*. In the embodiment, the above mechanism that widens the space may be implemented by the movable blade unit 407, the biasing member 505, the cutter levers 510, the cutout 511 of each of the cutter levers 510, the cover opening switch 805, the protrusion 808 of the movable blade unit 407, the movable blade driving motor, and the control unit.

As described above, according to the printer 201 of the embodiment, when the cover opening lever 107 is operated in the opening direction, before the engagement between the boss 802 provided in the casing main body 104 and the cutout 803 of the cover opening lever 107 is disengaged and the cover unit 502 is rotated in the opening direction, the movable blade 405*b* is accommodated constantly in the accommodating unit 407*a*. Thereby, the cover unit 502 is never opened where the movable blade 405*b* is left protruding from the accommodating unit 407*a* and therefore, the operator is prevented assuredly from touching the movable blade 405*b*.

As described above, the printer 201 of the present embodiment includes a recording medium accommodating unit 301; a printer main body 501 that includes a printing unit 401 that prints on a recording medium 202 conveyed from the recording medium accommodating unit 301; a cover unit 502 that is rotatably attached to the printer main body 501 and covers the recording medium accommodating unit 301; a fixed blade 405*a* that is attached to the cover unit 502 downstream from the printing unit 401 in a recording medium conveyance direction; a movable blade 405*b* that faces the fixed blade 405*a*, freely reciprocates relative to the fixed blade 405*a* when the cover unit 502 is closed, and upon reciprocating and in cooperation with the fixed blade 405*a*, cuts the recording medium 202 inserted between the movable blade 405*b* and the fixed blade 405*a* by overlapping a side of the fixed blade 405*a* downstream in the recording medium conveyance direction; a movable blade driving motor that causes the movable blade 405*b* to reciprocate; and a movable blade unit 407 that includes the movable blade 405*b*, the movable blade driving unit, and an accommodating unit 407*a* accommodating the movable blade 405*b*, the movable blade unit 407 being provided at the printer main body 501. The printer 201 further includes a mechanism that, when the movable blade 405*b* is protruded from the accommodating unit 407*a* and is stopped, widens a space over which the fixed blade 405*a* and the protruding movable blade 405*b* face each other before the movable blade driving unit accommodates the protruding movable blade 405*b* in the accommodating unit 407*a*, as initiated by operation of the cover opening lever 107.

According to the printer 201 of the embodiment, when the cover opening lever 107 is operated in the state where the movable blade 405*b* is stopped at the position at which the movable blade 405*b* protrudes from the accommodating unit 407*a*, before the protruding movable blade 405*b* is accommodated in the accommodating unit 407*a*, an allowance of space enabling the movable blade 405*b* to operate is secured by widening the space over which the fixed blade 405*a* and the protruding movable blade 405*b* face each other.

Thereby, when the cover opening lever 107 is operated in the state where the movable blade 405*b* is stopped at the position at which the movable blade 405*b* protrudes from the accommodating unit 407*a*, after the space over which the fixed blade 405*a* and the protruding movable blade 405*b* face each other is widened, the protruding movable blade 405*b* is accommodated securely in the accommodating unit 407*a* by the movable blade driving unit and thereafter, the cover unit 502 may be opened.

The printer 201 of the embodiment includes the biasing member 505 that biases the movable blade unit 407 in a downstream direction with respect to the conveyance direction of the recording medium 202, and the movable blade unit locking mechanism 512 that locks the movable blade unit 407 to the printer main body 501 in a state where the movable blade 405*b* overlaps the fixed blade 405*a*, and is characterized in that the printer 201 is adapted to release the movable blade unit locking mechanism 512 by an operation of the cover opening lever 107.

According to the printer 201 of the present embodiment, the movable blade unit 407 is biased toward the downstream side in the recording medium 202 conveyance direction and therefore, when locking of the movable blade unit 407 by the movable blade unit locking mechanism 512 is released in conjunction with the operation of the cover opening lever 107, accompanying the release, the movable blade unit 407 is moved to a position downstream in the recording medium 202 conveyance direction, and an allowance of space enabling the movable blade 405*b* to operate is secured.

Thereby, using the existing biasing member 505 of the movable blade unit 407 that is provided to simplify detachment operation for the movable blade unit 407, an allowance of space enabling the movable blade 405*b* to operate is secured, and the cover unit 502 may be opened after securely accommodating the protruding movable blade 405*b* in the accommodating unit 407*a* by the movable blade driving motor, without any complication of the configuration.

Further, the printer 201 according to the present embodiment further includes a cover unit locking mechanism 804 that is locks with the printer main body 501 when the cover unit 502 is closed, where the printer 201 is configured to release the cover unit locking mechanism 804 by operation of the cover opening lever 107.

According to the printer 201 of the present embodiment, the space over which the fixed blade 405*a* and the protruding movable blade 405*b* face each other may be widened accompanying the release of the locking by the cover unit locking mechanism 804 in conjunction with the operation of the cover opening lever 107. Therefore, when the locking by the cover unit locking mechanism 804 is released to open the cover unit 502, the cover unit 502 is opened in a state where the movable blade 405*b* is accommodated securely in the accommodating unit 407*a*.

Thus, simply by the operator of the printer 201 executing an operation to open the cover unit 502, an allowance of space enabling the movable blade 405*b* to operate is secured, and the cover unit 502 may be opened after the protruding movable blade 405*b* is securely accommodated in the accommodating unit 407*a* by the movable blade driving motor, without causing the operator of the printer to particularly pay attention to the accommodation of the movable blade 405*b*.

The printer 201 of the embodiment is characterized in that the movable blade unit 407 is provided at the printer main body 501 being detachable therefrom. According to the printer 201 of the embodiment, parts such as the movable blade 405*b* and the movable blade driving motor that constitute the movable blade unit 407 and degrade with use, can be replaced as a unit by replacing the movable blade unit 407. Therefore, simplification of the replacement operation accompanying degradation of the movable blade 405*b* and the movable blade driving motor is facilitated.

(Industrial Application)

As described above, the printer according to the present invention is useful for a printer that holds a recording medium wound in a roll and that prints on the recording medium, and is especially suitable for a printer that cuts the recording medium by sliding a movable blade relative to a fixed blade.

What is claimed is:

1. A printer comprising:

a recording medium accommodating unit;

a printer main body that includes a printing unit that prints on a recording medium conveyed from the recording medium accommodating unit;

a cover unit that is rotatably attached to the printer main body and covers the recording medium accommodating unit;

a fixed blade that is attached to the cover unit downstream from the printing unit in a recording medium conveyance direction;

a movable blade that faces the fixed blade, freely reciprocates relative to the fixed blade when the cover unit is closed, and upon reciprocating and in cooperation with the fixed blade, cuts the recording medium inserted between the movable blade and the fixed blade by overlapping a side of the fixed blade downstream in the recording medium conveyance direction;

a movable blade driving unit that causes the movable blade to reciprocate; and a movable blade unit that includes the movable blade, the movable blade driving unit, and an accommodating unit accommodating the movable blade, the movable blade unit being provided at the printer main body, wherein the printer further comprises a mechanism and an operating unit to operate the printer such that, when the movable blade is protruded from the accommodating unit and is stopped, the mechanism widens a space over which the fixed blade and the protruding movable blade face each other before the movable blade driving unit accommodates the protruding movable blade in the accommodating unit, as initiated by operation of the operating unit; and the printer further comprises a cover unit locking mechanism that locks with the printer main body when the cover unit is closed, wherein the printer is configured to release the cover unit locking mechanism by operation of the operating unit.

2. The printer according to claim 1, further comprising: a biasing member that biases the movable blade unit in a downstream direction with respect to the recording medium conveyance direction; and a movable blade unit locking mechanism that locks the movable blade unit to the printer main body when the movable blade overlaps the fixed blade, wherein the printer is configured to release the movable blade unit locking mechanism through operation of the operating unit.

3. The printer according to claim 1, wherein the movable blade unit is detachable from the printer main body.

4. The printer according to claim 2, wherein the movable blade unit is detachable from the printer main body.

* * * * *